United States Patent [19]

Hall

[11] Patent Number: 4,578,039

[45] **Date of Patent: * Mar. 25, 1986**

[54] MARINE HYDRAULIC STEERING SYSTEM CONTROL

[75] Inventor: Charles B. Hall, Ingleside, Ill.

[73] Assignee: Outboard Marine Corporation, Waukegan, Ill.

[ * ] Notice: The portion of the term of this patent subsequent to Feb. 14, 2001 has been disclaimed.

[21] Appl. No.: 556,963

[22] Filed: Dec. 1, 1983

Related U.S. Application Data

[63] Continuation-in-part of Ser. No. 258,874, Apr. 29, 1981, Pat. No. 4,431,422.

[51] Int. Cl.[4] ..... B63H 25/22

[52] U.S. Cl. ..... 440/61; 440/53; 114/144 R

[58] Field of Search ..... 114/150, 144 R, 163; 440/53, 61; 244/78, 226; 91/420

[56] References Cited

U.S. PATENT DOCUMENTS

| | | | |
|---|---|---|---|
| 3,576,192 | 4/1971 | Wood et al. | 137/102 |
| 3,738,228 | 6/1973 | Harrison | 91/499 |
| 3,908,687 | 9/1975 | Wood | 137/106 |
| 4,088,087 | 5/1978 | Nitta | 114/150 |
| 4,092,905 | 6/1978 | Wood | 91/499 |
| 4,271,780 | 6/1981 | Etoh | 114/144 |
| 4,431,422 | 2/1984 | Hall | 440/61 |

FOREIGN PATENT DOCUMENTS

| | | |
|---|---|---|
| 1271729 | 4/1972 | United Kingdom . |
| 2097350 | 11/1982 | United Kingdom . |
| 612850 | 6/1978 | U.S.S.R. . |
| 734063 | 6/1980 | U.S.S.R. . |

*Primary Examiner*—Galen L. Barefoot
*Assistant Examiner*—Edwin L. Swinehart
*Attorney, Agent, or Firm*—Michael, Best & Friedrich

[57] ABSTRACT

Disclosed herein is a hydraulic control unit for a marine installation comprising a helm station including a pump comprising first and second pump discharge ports, which pump is selectively and alternatively operable to deliver fluid under pressure from the first and second pump discharge ports, a plurality of steerable marine propulsion units, a plurality of corresponding hydraulic steering cylinders respectively connected to each of the propulsion units and including respective first ports which, when subject to fluid under pressure, tend to steer the propulsion units in one direction and including respective second ports which, when subject to fluid under pressure, tend to steer the propulsion units in the opposite direction, and hydraulic tie lines connecting the second port of each steering cylinder except the last steering cylinder with the first port of the following steering cylinder, which hydraulic control unit includes a hydraulic circuit adapted for communication between the first pump discharge port and the first steering cylinder first port and between the second pump discharge port and the last steering cylinder second port and with each of the tie lines and operable, during the presence of fluid under pressure at one of the first and second discharge ports, and in response to the absence of fluid under pressure in either one of the tie lines, for preventing steering movement of the other of the first and last propulsion units, and operable, when the steerable propulsion units are in nonangularly aligned steering positions, for locating the steerable propulsion units in angularly aligned positions.

21 Claims, 8 Drawing Figures

MARINE HYDRAULIC STEERING SYSTEM CONTROL

"RELATED APPLICATION"

This application is a continuation-in-part of my prior pending application Ser. No. 258,874, filed Apr. 29, 1981, now U.S. Pat. No. 4,431,422 issued Feb. 14, 1984.

BACKGROUND OF THE INVENTION

The invention relates generally to marine propulsion devices and, more particularly, to steering systems for marine propulsion devices. Still more particularly, the invention is directed to control valving interposed between a conventional two or three conduit helm steering station and three or more conventional marine propulsion devices each including a two-way hydraulic steering cylinder having, at the ends thereof, opposed ports.

Attention is directed to the prior Harrison U.S. Pat. No. 3,738,228, issued June 12, 1973 and to the Wood U.S. Pat. No. 4,092,905, issued June 6, 1978, which patents disclose prior art steering helms.

Attention is also directed to the prior Wood U.S. Pat. Nos. 3,576,192 issued Apr. 27, 1971, and 3,908,687 issued Sept. 30, 1975, which patents disclose control valves for interposition between a helm station and a marine propulsion device.

Attention is also directed to the prior art marine installations described hereinafter under the heading "General Description".

Attention is also directed to the Hall, et al. U.S. Pat. No. 4,373,920 issued Feb. 15, 1983.

Attention is also directed to Etoh U.S. Pat. No. 4,271,780 issued June 9, 1981; Nitta U.S. Pat. No. 4,088,087 issued May 9, 1978; U.S.S.R. Druzhinin Patent No. 734,063 issued June 1, 1980; U.S.S.R. Mikhailov Patent No. 612,850 issued June 29, 1978; and British Pat. No. 1,271,729 published Apr. 26, 1972.

SUMMARY OF THE INVENTION

The invention provides a hydraulic control unit for a marine installation comprising a helm station comprising a pump including first and second pump discharge ports, and means for selectively and alternatively delivering fluid under pressure from the pump to the first and second pump discharge ports, first, second, and third steerable propulsion units, first, second, and third hydraulic steering cylinders respectively connected to the first, second, and third propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, and a second tie line connecting the second steering cylinder second port and the third steering cylinder first port, which hydraulic control unit includes means which is adapted for communication between the first pump discharge port and the first steering cylinder first port and between the second pump discharge port and the third steering cylinder second port and each of the tie lines and which is operable, during the presence of fluid under pressure at one of the first and second discharge ports, and in response to the absence of fluid under pressure in either one of the tie lines, for preventing steering movement of one of the first, second, and third propulsion units.

In addition, the invention also provides a marine installation including the control unit described immediately above.

The invention also provides a hydraulic control unit for a marine installation comprising a helm station comprising a pump including first and second pump discharge ports, and means for selectively and alternatively delivering fluid under pressure from the pump to the first and second pump discharge ports, first, and third steerable marine propulsion units, first, second, and third hydraulic steering cylinders respectively connected to the first, second, and third propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, and a second tie line connecting the second steering cylinder second port and the third steering cylinder first port, which hydraulic control unit includes means which is adapted for communication between the first pump discharge port and the first steering cylinder first port and between the second pump discharge port and the third steering cylinder second port and with each of the tie lines, which is operable, during the presence of fluid under pressure at one of the first and second discharge ports, and in response to the absence of fluid under pressure in either one of the tie lines, for preventing steering movement of one of the first, second, and third propulsion units, and which is operable, when the steerable propulsion units are in nonangularly aligned steering positions, for locating the steerable propulsion units in angularly aligned position.

In addition, the invention also provides a marine installation including the control unit described immediately above.

Other features and advantages of the embodiments of the invention will become known by reference to the following general description, claims and appended drawings.

IN THE DRAWINGS

Figure 1:
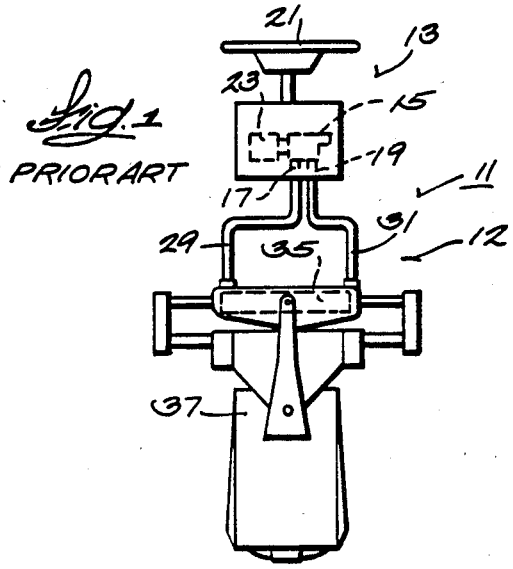
Fig. 1 PRIOR ART
FIG. 1 is a fragmentary and diagrammatic view of a prior art marine propulsion installation.

Before explaining some embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown fragmentarily and schematically in FIG. 1 is a prior art marine propulsion installation 11 including a steering system 12 comprising a helm station 13 including a hydraulic pump 15 having first and second discharge ports 17 and 19, together with a steering wheel 21 which operates the pump 15 to deliver fluid under pressure from a selected one of the first and second pump discharge ports 17 and 19, depending upon the direction of the rotation of the steering wheel 21. Also included in the helm station 13 is a fluid reservoir or sump 23 which communicates with the pump 15. The first and second discharge ports 17 and 19 of the helm station 13 are connected by respective conduits 29 and 31 with the opposite ends of a steering cylinder piston assembly 35 which is connected to a steerable propulsion unit 37 for controlling steering movement thereof. Accordingly, supply of fluid under pressure through one of the conduits 29 and 31 effects actuation of the steering cylinder-piston assembly 35 to provide propulsion unit steering in one direction, and supply of fluid under pressure in the other of the conduits 29 and 31 effects actuation of the cylinder-piston assembly 35 to provide propulsion unit steering in the opposite direction. Such prior art installations are referred to as two-line steering systems.

Figure 2:
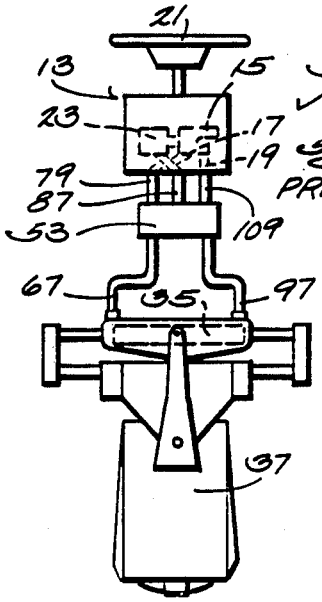
Fig. 2 PRIOR ART
FIG. 2 is a fragmentary and diagrammatic view of a second prior art marine propulsion installation.

Shown fragmentarily and schematically in FIG. 2 is another prior art marine installation 51 in which steering movements originated at or by the propulsion unit are prevented. The installation 51 shown in FIG. 2 includes a helm station 13 as already generally explained in regard to FIG. 1. The marine installation 51 shown in FIG. 2 also includes a single cylinder-piston assembly 35 operable to effect steering of a propulsion unit 37. Located between the helm station 13 and the cylinder-piston assembly 35 is an auxiliary no-back steering valve assembly 53 which is operative to prevent steering caused by forces which are generated at or by the propulsion unit 37.

Figure 3:
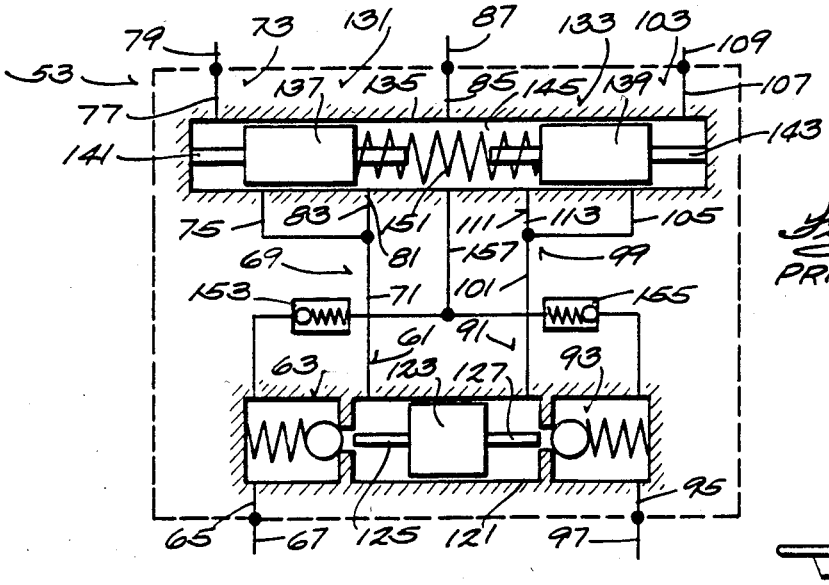
Fig. 3 PRIOR ART
FIG. 3 is a diagrammatic view of a control valve incorporated in the marine propulsion installation shown in FIG. 2.

More particularly, the valve assembly 53 is shown in greater detail in FIG. 3 and includes a first fluid line 61 including a normally closed, first check valve 63 dividing the first line 61 into a downstream portion 65 communicating (See FIG. 2) through a conduit 67 with one end of the steering cylinder-piston assembly 35 and an upstream portion 69 having a common branch 71, a supply branch 73 including a downstream part 75 communicating with the common branch 71, and an upstream part 77 communicating through a conduit 79 (See FIG. 2) with the first pump discharge port 17, and a return branch 81 including an upstream part 83 communicating with the common branch 71 and a downstream part 85 communicating (See FIG. 2) through a conduit 87 with the sump 23 at the helm station 13.

The no-back steering valve assembly 53 also includes a second fluid line 91 including a normally closed, second check valve 93 dividing the second line 91 into a downstream portion 95 communicating (See FIG. 2) through a conduit 97 with the other end of the steering cylinder-piston assembly 35, and an upstream portion 99 having a common branch 101, a supply branch 103 including a downstream part 105 communicating with the common branch 101, and an upstream branch 107 communicating (See FIG. 2) through a conduit 109 with the second pump discharge port 19, and a return branch 111 including an upstream part 113 communicating with the common branch 101 and a downstream part formed in common with the downstream part 85 of the return branch 81 of the upstream portion of the first fluid line 61 and which communicates (See FIG. 2) through the conduit 87 with the sump 23.

The no-back steering valve assembly 53 also includes means responsive to fluid under pressure in the upstream portion of the first line 61 for opening the second check valve 93 and responsive to fluid pressure in the upstream portion of the second line 91 for opening the first check valve 63. While various arrangements can be employed, in the illustrated prior construction, such means comprises a control cylinder 121 which, at its opposite ends, respectively communicates with the common branches 71 and 101 of the upstream portions of the first and second fluid lines 61 and 91, together with a piston 123 which is located centrally in the control cylinder 121 and which, at its opposite ends, include respective projections 125 and 127 adapted to engage the first and second check valves 63 and 93 for opening thereof in response to the presence of fluid under pressure in the opposite one of the first and second fluid lines 61 and 91.

Means are also provided, with respect to each of the first and second fluid lines 61 and 91, for selectively and alternatively permitting fluid flow in one of the supply and return branches while preventing flow in the other of the supply and return branches. While various other arrangements can be employed, in the illustrated construction, such means includes a first shuttle valve 131 operable selectively, in a first mode and in response to fluid under pressure in the upstream part 77 of the first line supply branch 73, to permit fluid flow from the upstream part 77 to the downstream part 75 of the first line supply branch 73 and to prevent fluid flow in the first line return branch 81, and in a second mode and in response to the absence of fluid under pressure in the upstream part 77 of the first line supply branch 73, to permit fluid flow from the upstream part 83 to the downstream part 85 of the first line return branch 81, and to prevent fluid flow through the first line supply branch 73.

Additionally, the means for selectively and alternately permitting fluid flow in the supply and return branches includes a second shuttle valve 133 operable, in a first mode and in response to fluid under pressure in the upstream part 107 of the second line supply branch 103, to permit fluid flow from the upstream part 107 to the downstream part 105 of the second line supply branch 103 and to prevent fluid flow in the second line return branch 111 and, in a second mode and in response to the absence of fluid under pressure in the upstream part 107 of the second line supply branch 103, to permit fluid flow from the upstream part 113 to the downstream part 85 of the second line return branch 111 and to prevent fluid flow through the second line supply branch 103.

In the illustrated construction, the shuttle valves 131 and 133 are provided by a common cylinder 135 and respective first and second pistons 137 and 139 which are identically constructed, which are located in axially spaced relation in the cylinder 135, and which respectively include, at their remote ends, reduced diameter extensions 141 and 143 adapted respectively to engage the adjacent ends of the cylinder 135 so as to respectively locate the pistons 137 and 139 in positions so that the cylinder ends communicate with the upstream parts 77 and 107 of the supply branches 73 and 103 of the first and second lines 61 and 91, respectively, so that the downstream parts 75 and 105 of the supply branches 73 and 103 of the first and second fluid lines 61 and 91 are respectively closed by the pistons 137 and 139, and so that the upstream parts 83 and 113 of the return branches 81 and 111 of the first and second fluid lines 61 and 91 communicate with the area 145 which is located within the cylinder 135 between the pistons 137 and 139, and which communicates with the downstream part 85 of the return branches 81 and 111 of the first and second fluid lines 61 and 91.

Preferably, as shown in FIG. 3, a biasing spring 151 is located in the cylinder 135 and between the pistons 137 and 139 so that, in the absence of fluid under pressure at one of the ends of the cylinder 135, the pistons 137 and 139 are located with the extensions 141 and 143 in engagement with the adjacent ends of the cylinder 135 so as thereby to prevent fluid flow in the supply branches 73 and 103 and to permit fluid flow in the return branches 81 and 111. As is apparent, the presence of fluid under pressure at one of the ends of the cylinder 135 will cause displacement of the adjacent one of the pistons 137 and 139 against the action of the spring 151 to close the adjacent one of the return branches 81 and 111 and to open the adjacent one of the supply branches 73 and 103.

Because the check valve 63 and 93 are biased closed in the absence of fluid under pressure in the common branches 71 and 101 of the first and second fluid lines 61 and 91, means are provided for relieving excessive pressure which may occur in the downstream portions 65 and 95 of the first and second fluid lines 61 and 91. While various arrangements can be employed, in the illustrated construction, such means comprises first and second pressure relief valves 153 and 155 which communicate respectively with the downstream portions 65 and 95 of the first and second fluid lines 61 and 91 and with a third common duct or line 157 which communicates through the central cylinder area 145, and through the conduit 87 with the sump 23 at the helm station 13. The pressure relief valves 153 and 155 are regulating relief valves which bleed excess pressures, while maintaining a given pressure upstream of the valve. Such prior art arrangements which are shown in FIGS. 2 and 3 are sometimes referred to as three-line steering systems.

Figure 4:
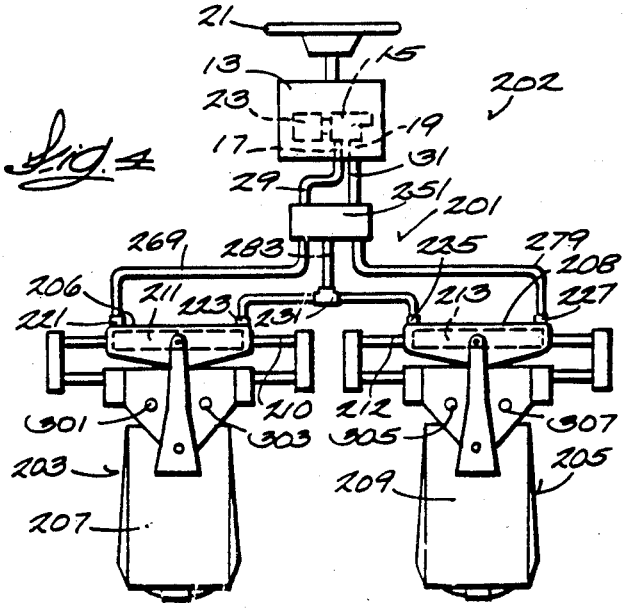
FIG. 4 is a fragmentary and diagrammatic view of a first marine propulsion installation.

Shown fragmentarily and schematically in FIG. 4 is a marine installation comprising a steering system 202 which includes a prior art helm station 13 such as disclosed in connection with FIG. 1 and which is adapted to control steering activity of first and second marine propulsion devices 203 and 205 which respectively include first and second propulsion units 207 and 209 which are connected to and steerable in response to action of respective first and second steering cylinder-piston assemblies 211 and 213. The first steering cylinder-piston assembly 211 includes opposed first and second ports 221 and 223 and the second steering cylinder-piston assembly 213 includes opposed first and second ports 225 and 227. As shown, the second port 223 of the first steering cylinder-piston assembly 211 is hydraulically connected by a tie line 231 to the first port 225 of the second cylinder-piston assembly 213.

The illustrated hydraulic cylinder-piston assemblies 211 and 213 include respective hydraulic cylinders 206 and 208 which are movable left and right on respective first and second rods 210 and 212 fixed against lateral movement and which are respectively connected to the propulsion units 207 and 209 such that movement of the hydraulic cylinders 206 and 208 on the rods 210 and 212 causes associated steering movement of the respective propulsion units 207 and 209. The specific construction of the arrangement is more fully disclosed in Hall et al U.S. Pat. No. 4,373,920 issued Feb. 15, 1983, which is incorporated herein by reference. Other steering arrangements utilizing two-way hydraulic cylinders can also be employed.

Figure 5:
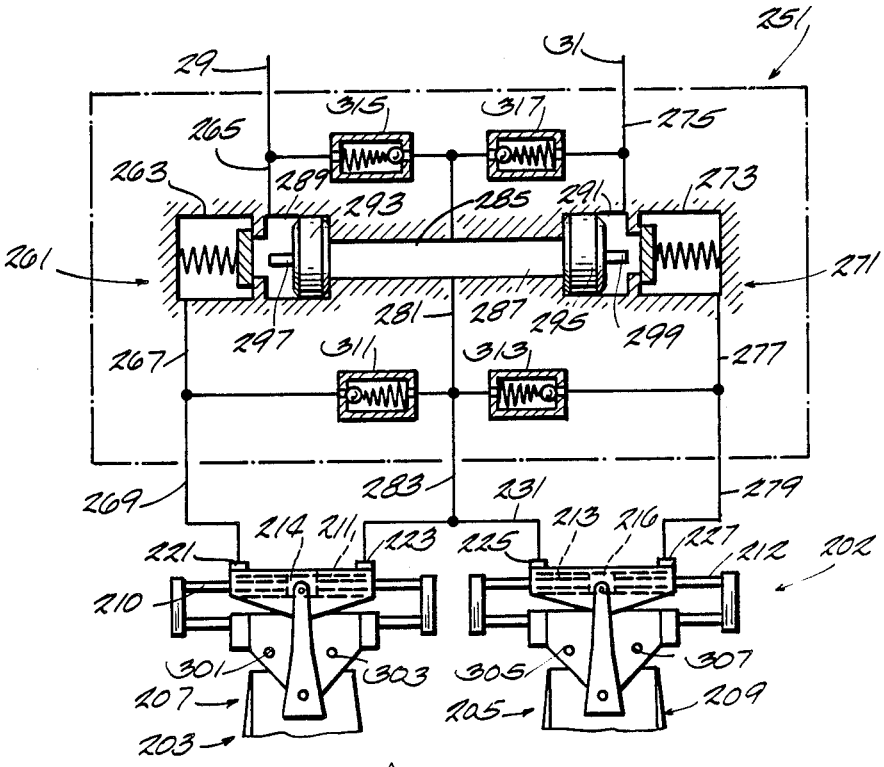
FIG. 5 is a diagrammatic view of a control unit incorporated in the marine propulsion installation shown in FIG. 4.

Interconnected between the helm station 13 and the steering cylinder-piston 211 and 213 is a control unit 251 which is shown best in FIG. 5 and which includes means operable, during the presence of fluid under pressure at one of the first and second discharge ports 17 and 19, and in response to the absence of fluid under pressure in the tie line 231, for preventing steering movement of the other of the first and second propulsion units 207 and 209, and means operable, when the steerable propulsion units 207 and 209 are in nonangularly aligned steering positions, for locating the steerable propulsion units 207 and 209 in angularly aligned positions.

The means operable, during the presence of fluid under pressure at one of the first and second discharge ports 17 and 19, and in response to the absence of fluid under pressure in the tie line 231, for preventing steering movement of the other of the first and second propulsion units 207 and 209, comprises, as shown in FIG. 5, a first fluid line 261 including a first one-way normally closed check valve 263 which selectively operates to supply and return hydraulic fluid between (see FIG. 4) the first pump discharge port 17 and the steering cylinder port 221, which divides the first fluid line 261 into an upstream portion 265 connected (see FIG. 4) through the conduit 29 to the first pump discharge port 17 and a downstream portion 267 connected (see FIG. 4) through a conduit 269 to the first port 221 of the steering cylinder 211 of the first marine propulsion device 203.

The control unit 251 further includes a second fluid line 271 including a second normally closed check valve 273 which selectively operates to supply and return hydraulic fluid between (see FIG. 4) the second pump discharge port 19 and the second port 227 of the hydraulic steering cylinder 213 of the second marine propulsion device 205 and which divides the second fluid line 271 into an upstream portion 275 connected (see FIG. 4) through the conduit 31 to the second pump discharge port 19 and a downstream portion 277 connected (see FIG. 4) through a conduit 279 to the second port 227 of the hydraulic steering cylinder 213 of the second marine propulsion device 205.

It is noted that because the check valves 263 and 273 are normally biased closed and therefore remain closed in the absence of fluid under pressure in the upstream portions 265 and 275 of the first and second fluid lines 261 and 271, the means operable, during the presence of fluid under pressure at one of the first and second discharge ports 17 and 19, and in response to the absence of fluid under pressure in the tie line 231, for preventing steering movement of the other of the first and second propulsion units 207 and 209 also includes means for selectively opening the check valves 263 and 273 to permit return fluid flow from one of the downstream steering cylinders 211 and 213 to the sump 23 in response to the presence of positive pressure in the tie line 231. Accordingly, in the absence of positive pressure in the tie line 231, the downstream or return one of the check valves 263 and 273 will remain closed until the fluid supply line provides sufficient fluid under presure to create a positive pressure in the tie line.

Still more specifically, the means for selectively opening the check valves 263 and 273 in response to the presence of fluid under pressure in the tie line 231 includes (see FIG. 5) a third fluid line 281 which communicates through a conduit 283 with the tie line 231 and which communicates through branch lines 285 and 287 with respective first and second control cylinders 289 and 291 which respectively include first and second control pistons 293 and 295 having respective extensions 297 and 299 for respective engagement with the first and second check valves 263 and 273 for opening thereof in response to a pressure in the tie line 231 greater than the pressure in the upstream portion of the one of the first and second lines 261 and 271 which serves as the return line.

Thus, when the first line 261 serves as the supply line, and when positive pressure is absent in the tie line 231, i.e., during the presence of a vacuum condition in the tie line 231, the second check valve 273 in the second or return line 271 will remain closed until the fluid supply through the first or supply line 261 developes a positive pressure in the tie line 231. Such development of positive pressure in the tie line 231 serves to cause the second control piston 295 to open the second check valve 273 in the second or return line 271, thereby permitting return flow from the second steering cylinder 213 through the second or return line 271.

Operation of the control unit 251 when the second line 271 serves as the supply line is similar to that just described except that positive pressure in the tie line 231 causes the first control piston 293 to open the first check valve 263 in the first line 261 which serves as the return line.

The means operable, when the steerable propulsion units 207 and 209 are in nonangularly aligned steering positions, for locating the steerable propulsion units 207 and 209 in angularly aligned positions includes employment of mechanical stops for limiting steering movement in opposite directions. Such stops can be provided by various arrangements, as for instances, port and starboard stops 301 and 303 on the marine propulsion device 203 and port and starboard stops 305 and 307 on the marine propulsion device 205 (see FIG. 4), or by engagement of the ends of the steering cylinders 211 and 213 with the piston 214 and 216 respectively housed therein, or by other means to limit propulsion unit movement.

When propulsion unit steering movement is limited by reason of engagement by either the port or starboard stops, the propulsion units 207 and 209 will be located in corresponding angular positions and the fluid volumes at opposite sides of the steering cylinder pistons will be correct for causing simultaneous propulsion unit steering with the propulsion units 207 and 209 located in corresponding angular positions.

The means operable, when the steerable propulsion units 207 and 209 are in nonangularly aligned steering positions, for locating the steerable propulsion units 207 and 209 in angularly aligned positions also includes, as also shown in FIG. 5, first and second one-way pressure relief valves 311 and 313 which communicate respectively between the downstream portions 267 and 277 of the first and second lines 261 and 271 and the third line 281 and which, in response to the presence of fluid under pressure above a predetermined level in the first and second lines 261 and 271, permit fluid flow from the downstream portions 267 and 277 to the tie line 231. In addition, the means operable, when the steerable propulsion units 207 and 209 are in nonangularly aligned steering positions, for locating the steerable propulsion units 207 and 209 in angularly aligned positions further includes third and fourth pressure relief valves 315 and 317 which communicate between the third line 281 and the upstream portions 265 and 275 of the first and second lines 261 and 271 and which, in response to the presence of fluid under pressure in the third line 281 above a predetermined level, permit fluid flow from the third line 281 to the upstream portions 265 and 275 of the first and second lines 261 and 271 for return to the helm station sump 23. The pressure relief valves 311, 313, 315, and 317 are regulating relief valves which bleed excess pressure, while maintaining a given pressure upstream of the valve.

Thus, if fluid under pressure is supplied to the first line 261 so as to cause counter-clockwise propulsion unit steering in response to steering cylinder movement to the left in FIGS. 4 and 5 and the second propulsion unit 209 arrives at the stop 305 without the first propulsion unit 207 encountering the stop 301, the build-up of pressure in the tie line 231 and the third line 281 will open the relief valve 317 permitting flow from the steering cylinder 211 and continued movement of the first propulsion unit 209 until arrival at the stop 301.

If the first propulsion unit 207 contacts the stop 301 first, the build-up of pressure in the downstream portion 267 of the first supply line 261 will open the relief valve 311 permitting flow of fluid under pressure to the third line 281 and then to the tie line 231 and to the second steering cylinder 213 so as to effect continuation of steering movement of the second propulsion unit 209 until arrival at the stop 305.

In a similar manner when the second line 271 serves as the supply line so as to cause clockwise propulsion unit steering movement in FIGS. 4 and 5, the pressure relief valves 313 and 315 operate to facilitate location of the propulsion units 207 and 209 against their respective stops 303 and 307 and therefore in corresponding angular position so as thereby to facilitate subsequent steering action with the propulsion units 207 and 209 in corresponding angular location. Thus, when the propulsion unit 209 is located against the stop 307, the pressure relief valve 313 opens to provide a path for supplying fluid to the steering cylinder 211.

Similarly, when the second line 271 serves as the supply line, and the propulsion unit 207 arrives at the stop 303, the pressure relief valve 315 opens to provide a path for returning fluid to the helm station 13 through the first line 261.

Figure 6:
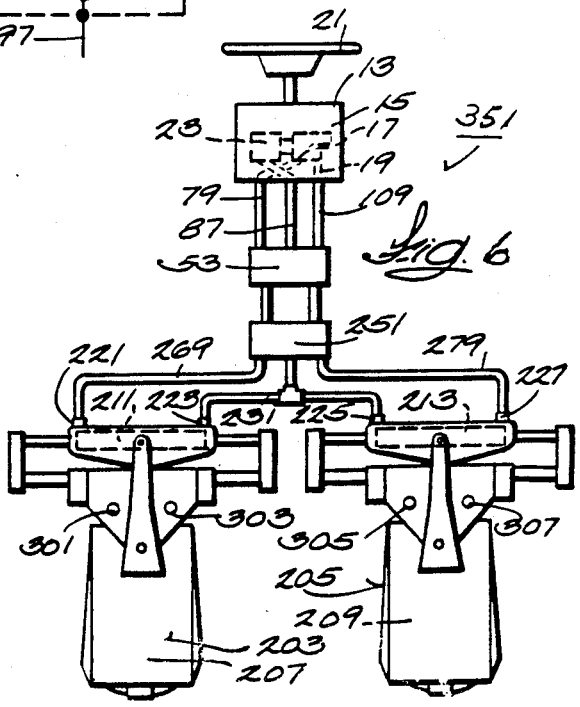
FIG. 6 is a fragmentary and diagrammatic view of a second marine propulsion installation.

Shown fragmentarily and schematically in FIG. 6 is another marine propulsion installation 351 which is adapted for interposition in a steering system between the assembly of a helm station 13 and valve assembly 53, such is shown in FIG. 2, and a pair of marine propulsion units 207 and 209 such as shown in FIG. 4. The marine installation 351 also includes the control unit 251 which is shown in FIG. 5 and which is connected intermediate the no-back steering valve assembly 53 shown in FIGS. 2 and 3 and the first and second steering cylinders 211 and 213 associated with the first and second marine propulsion units 207 and 209.

Figure 7:
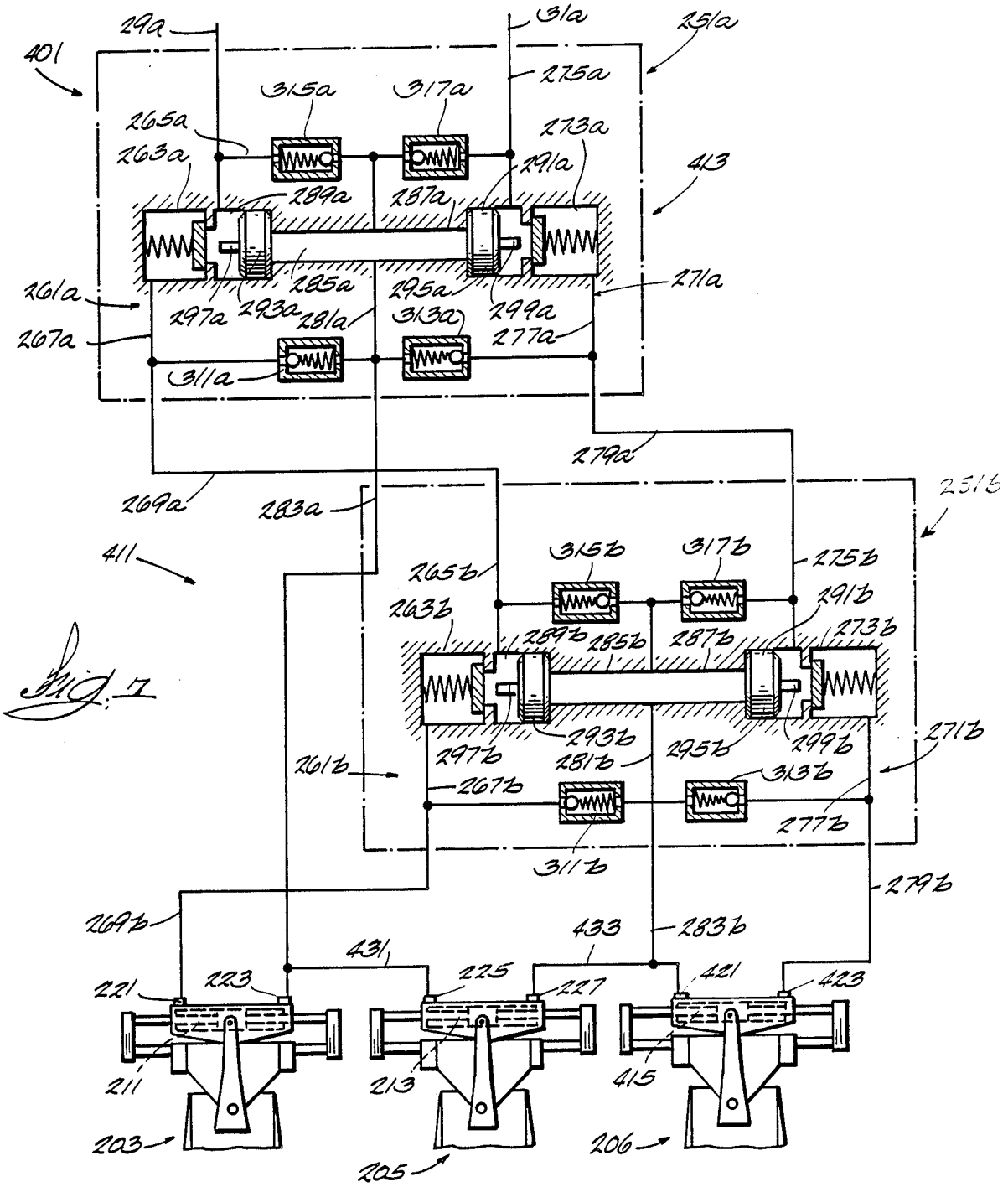
FIG. 7 is a diagrammatic view of a control unit incorporated in a marine propulsion installation which embodies various of the features of the invention.

Shown fragmentarily and schematically in FIG. 7 is another marine installation 401 including a steering system 411 comprising a control unit 413 which is adapted for interposition between a helm station 13, such as shown in FIG. 1, or a helm station 13 and no-back valve assembly 53, such as shown in FIG. 2, and a plurality of marine propulsion devices 203, 205, and 206. Various of the steering system components which are generally identical to the components of the steering system 202 shown in FIGS. 4, 5 and 6 will not again be described and are identified in the drawings by the same numerals as used with respect to the corresponding components of the systems shown in FIGS. 4, 5 and 6.

The steering system 411 differs from the steering system of FIGS. 4, 5 and 6 by the addition of a third marine propulsion device 206 which includes a third steering cylinder 415. The third steering cylinder 415 includes opposed first and second ports 421 and 423. In the steering system shown in FIG. 7, the second port 223 of the first steering cylinder 211 is connected by a first or left hydraulic tie line 431 to the first port 225 of the second steering cylinder 213, and the second port 227 of the second steering cylinder 213 is connected by a second or right tie line 433 to the first port 421 of the third hydraulic steering cylinder 415.

The control unit 413 includes means operable, during the presence of fluid under pressure at one of the first and second discharge ports 17 and 19, and in response to the absence of fluid under pressure in either one of the tie lines 431 and 433, for preventing steering movement of one of the first, second and third propulsion units, and means operable, when the steerable propulsion units are in nonangularly aligned steering positions, for locating the steerable propulsion units in angularly aligned positions.

More particularly, the control unit 413 comprises two control units 251*a* and 251*b* which are modified versions of the control unit 251. All of the components of the control units 251*a* and 251*b* are identical to control unit 251, except as discussed below. The components of the control units 251*a* and 251*b* have therefore been identified in the drawings by the same numerals used with respect to the corresponding components of the control unit 251 shown in FIG. 5, only with the suffix "a" or "b" to distinguish between the first unit 251*a* and the second unit 251*b*.

Control unit 251*a* is in communication with control unit 251*b* so that the first fluid line 261*a* communicates with the first fluid line 261*b* and the second fluid line 271*a* communicates with the second fluid line 271*b*. More particularly, conduit 269*a* communicates with the upper portion 265*b* of fluid line 261*b*, conduit 279*a* communicates with the upper portion 275*b* of fluid line 271*b*, conduit 269*b* communicates with the first cylinder port 221 of the first propulsion unit 203, and conduit 279*b* communicates with the second cylinder port 423 of the third propulsion unit 206. Conduit 283*a* communicates with tie line 431, and conduit 283*b* communicates with tie line 433.

The means operable during the presence of fluid under pressure at one of the first and second discharge ports 17 and 19 and in response to the absence of fluid under pressure in either the tie line 431 or the tie line 433 for preventing steering movement of the other of the first, second and third propulsion units, 203, 205 and 206, respectively, comprises the first and second normally closed check valves 263*a* and 273*a*, and the means for selectively opening the check valves 263*a* and 273*a* in response to fluid under pressure in the tie line 431.

In addition, the means operable during the presence of fluid under pressure at one of the first and second discharge ports 17 and 19 and in response to the absence of fluid under pressure in either the tie line 431 or the tie line 433 includes the normally closed first and second check valves 263*b* and 273*b*, and the means for selectively opening the check valves 263*b* and 273*b* in response to fluid under pressure in the tie line 433.

More particularly, the first normally closed valve 263*a* will close the first fluid lines 261*a* and 261*b*, and the second normally closed check valve 273*a* will close the second fluid lines 271*a* and 271*b* in the absence of fluid under pressure in conduit 283*a*, and the first normally closed check valve 263*b* will close the first fluid lines 261*a* and 261*b*, and the second normally closed check valve 273*b* will close the second fluid lines 271*a* and 271*b*, in the absence of fluid under pressure in conduit 283*b*.

When the first fluid lines 261*a* and 261*b* serves as the supply line, and when positive pressure is absent in the tie line 431, i.e., during the presence of a vacuum condition in the tie line 431, the second check valve 273*a* and the second fluid lines 271*a* and 271*b* remain closed until the fluid supplied through the first fluid lines 261*a* and 261*b* develop a positive pressure in the tie line 431. Such development of positive pressure in the tie line 431 serves to cause the second control piston 295*a* to open the second check valve 273*a* and open the second fluid line 271*a*.

The second fluid line 271*b* of control unit 251*b* remains closed, however, in the absence of positive pressure in the tie line 433, since the second check valve 273*b* and the second fluid line 271*b* remain closed until the fluid supplied through the first supply lines 261*a* and 261*b*, and the fluid from cylinder 211 and cylinder 213 serve to develop a positive pressure in the tie line 433. Such development of positive pressure in the tie line 433 causes the second control piston 295*b* to open the second check valve 273*b* in the second fluid line 271*b*, thereby permitting return flow from the cylinder 415 through the second return lines 271*b* and 271*a*, and movement of the steerable propulsion unit 206.

Operation of the control unit 413 when the second fluid lines 271*a* and 271*b* serve as the supply line is similar to that just described, except that positive pressure in the tie line 433 causes the first control piston 293*b* to open the first check valve 263*b* in the first fluid line 261*b*, and positive pressure in the tie line 431 causes the first control piston 293*a* to open the first check valve 263*a* in the first fluid line 261*a*. The first fluid lines 261*a* and 261*b* then serve as the return line.

Control unit 413 also comprises means operable when the steerable propulsion units 203, 205 and 206 are in nonangularly aligned steering positions for locating the steerable propulsion units 203, 205 and 206 in angularly aligned position. Such means comprises the relief valves and stops described in reference to control unit 251, with one exception. Since the relief valves 317*a* and 313*a* are in communication with hydraulic lines across two steerable propulsion units 205 and 206, the fluid under pressure operable to open the relief valves 317*a* and 313*a* must be doubled due to the additive effect of the hydraulic fluid pressure across the two propulsion units 205 and 206. Similarly, relief valves 315*b* and 311*b* must also open only when subject to double the fluid under pressure operable to open the other relief valves. In other embodiments, relief valves 317*a*, 313*a*, 315*b* and 311*b* can be omitted with some sacrifice in hydraulic pressure protection.

Figure 8:
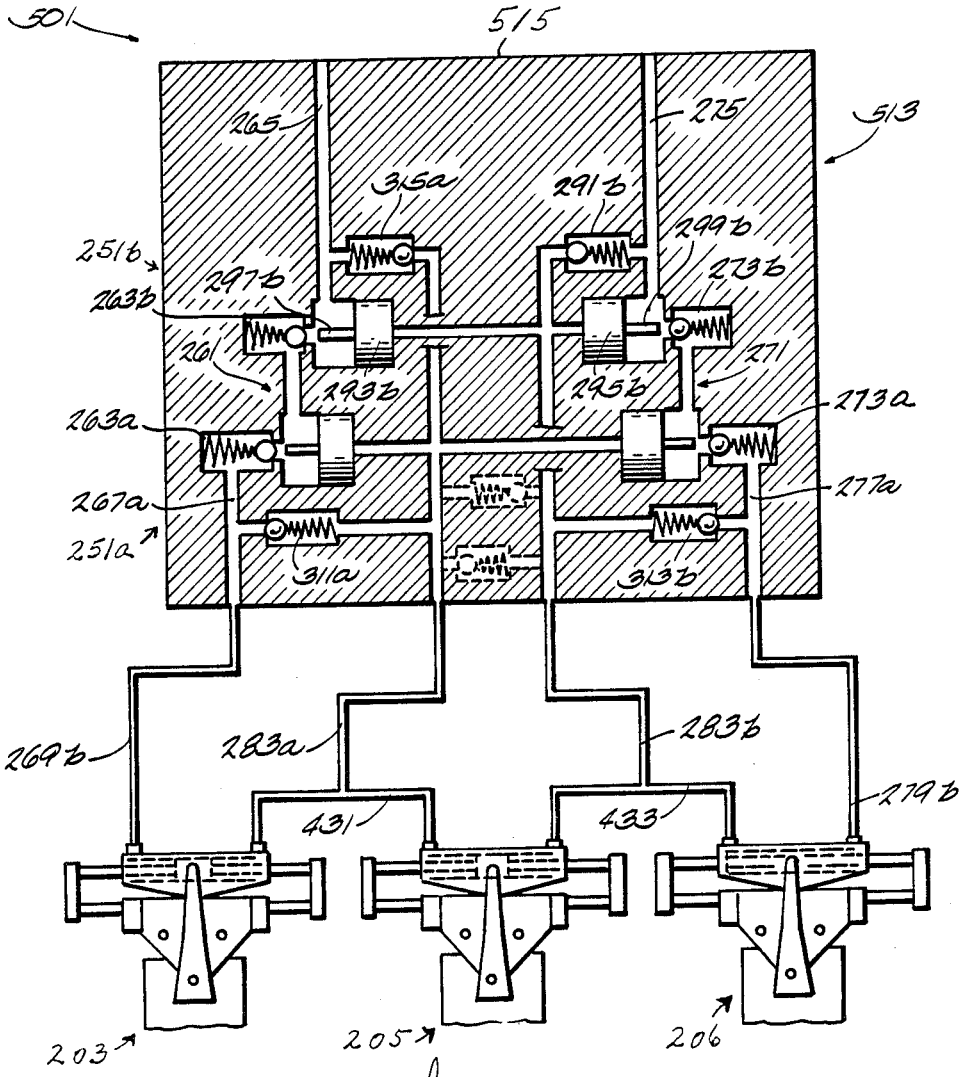
FIG. 8 is a diagrammatic view of a second control unit incorporated in a marine propulsion installation which embodies various of the features of the invention.

Shown fragmentarily and schematically in FIG. 8 is another marine propulsion installation 501 with a control unit 513. The installation 501 is similar to installation 401, only with the control unit 513 being a modified embodiment of the control unit 413.

All of the components of the control unit 513 are identical to control units 251*a* and 251*b*, except as identified below. The components of the control unit 513 have therefore been identified in the drawings by the same numerals used with respect to the corresponding components of the control units 251*a* and 251*b* shown in FIG. 7.

More particularly, the control unit 513 comprises the two control units 251*a* and 251*b* combined in a single housing 515, and the relief valves 317*a*, 313*a*, 315*b*, and 311*b* are eliminated. In other embodiments, other relief valves can be added between conduits 283*a* and 283*b* (as indicated by dashed lines in FIG. 8) for further pressure relief protection, if desired.

Various other features of the invention are set forth in the following claims:

I claim:

1. A hydraulic control unit for a marine installation comprising a helm station comprising a pump including first and second pump discharge ports, and means for selectively and alternatively delivering fluid under pressure from the pump to the first and second pump discharge ports, first, second and third steerable propulsion units, first, second and third hydraulic steering cylinders respectively connected to each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, a second tie line connecting the second steering cylinder second port and the third steering cylinder first port, said hydraulic control unit including a first hydraulic fluid line adapted for communication between the first pump discharge port and the first steering cylinder first port, a second hydraulic fluid line adapted for communication between the second pump discharge port and the third steering cylinder second port, and means adapted for communication with each of the tie lines and operably connected to said first and second fluid lines, and operable, during the presence of fluid under pressure supplied by the pump in one of the first and second fluid lines, and in response to the absence of fluid under pressure in any one of the tie lines, for preventing propulsion unit steering movement.

2. A hydraulic control unit for a marine installation comprising a helm station comprising a pump including first and second pump discharge ports, and means for selectively and alternatively delivering fluid under pressure from the pump to the first and second pump discharge ports, first, second and third steerable propulsion units, first, second and third hydraulic steering cylinders respectively connected to each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, a second tie line connecting the second steering cylinder second port and the third steering cylinder first port, said hydraulic control unit including a first hydraulic fluid line adapted for communication between the first pump discharge port and the first steering cylinder first port, said first fluid line including a pair of normally closed first check valves dividing said first line into an upstream portion adapted for communication with the first pump discharge port, and a downstream portion adapted for communication with the first steering cylinder first port, said first check valves opening in response to the presence of fluid under pressure in said upstream portion of said first line, a second hydraulic fluid line adapted for communication between the second pump discharge port and the third steering cylinder second port, said second fluid line including a pair of normally closed second check valves dividing said second line into an upstream portion adapted for communication with the second pump discharge port, and a downstream portion adapted for communication with said third steering cylinder second port, said second check valves opening in response to the presence of fluid under pressure in said upstream portion of said second line, and means adapted for communication with each of the tie lines and operably connected to said first and second fluid lines, and operable, during the presence of fluid under pressure supplied by the pump in one of the first and second fluid lines, and in response to the absence of fluid under pressure in any one of the tie lines, for preventing propulsion unit steering movement, said means for preventing propulsion unit steering movement being operative in the absence of fluid under pressure in one of said first and second lines and in response to the presence of fluid under pressure in all of the tie lines, for opening said pair of check valves in said one of said first and second lines.

3. A hydraulic control unit in accordance with claim 2 wherein said means operative for opening said pair of check valves in said one of said first and second lines comprises two sets of first and second cylinder-piston assemblies, each of which is respectively associated with a corresponding set of said first and second check valves, each of said cylinder-piston assemblies in each one of said sets of first and second cylinder-piston assemblies including a cylinder adapted at one end for communication with one of the tie lines and a piston movable in said cylinder and displaceable, in response to fluid under pressure in the one tie line, so as to effect opening of the associated one of said check valves.

4. A hydraulic control unit in accordance with claim 2 and further including means adapted for communication with one of the tie lines and operatively connected to each of the first and second fluid lines, and operable, when the steerable propulsion units are in nonangularly aligned steering positions, for locating the steerable propulsion units in angularly aligned positions.

5. A hydraulic control unit in accordance with claim 4 wherein said means for locating the steerable propulsion units in angularly aligned positions comprises a first plurality of pressure relief valves communicating with one of said first and second lines and respectively adapted for communication with each of the tie lines for permitting fluid flow from said one of said first and second lines to each of the tie lines when the pressure in said one of said first and second lines is above a predetermined value, and a second plurality of pressure relief valves respectively adapted for communication with each of the tie lines and with said upstream portion of the other of said first and second lines and permitting fluid flow from each of the tie lines to said upstream portion of said other of said first and second lines when the pressure in each of the tie lines is above a predetermined value.

6. A hydraulic control unit in accordance with claim 1 and further including means adapted for communication with one of the tie lines and operatively connected to each of the first and second fluid lines, and operable, when the steerable propulsion units are in nonangularly aligned steering positions, for locating the steerable propulsion units in angularly aligned positions.

7. A hydraulic control unit in accordance with claim 6 wherein said means for locating the steerable propulsion units in angularly aligned positions comprises a first plurality of pressure relief valves communicating with one of said first and second lines and respectively adapted for communication with each of the tie lines for permitting fluid flow from said one of said first and second lines to each of the tie lines when the pressure in said one of said first and second lines is above a predetermined value, and a second plurality of pressure reief valves respectively adapted for communication with each of the tie lines and with said upstream portion of the other of said first and second lines and permitting fluid flow from each of the tie lines to said upstream portion of said other of said first and second lines when the pressure in each of the tie lines is above a predetermined value.

8. A hydraulic control unit for a marine installation comprising a helm station comprising a pump including first and second pump discharge ports, and means for selectively and alternatively delivering fluid under pressure from the pump to the first and second pump discharge ports, a plurality of steerable propulsion units, a corresponding plurality of hydraulic steering cylinders respectively connected to each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, additional tie lines connecting successive steering cylinder second ports and the following steering cylinder first ports, said hydraulic control unit including a first hydraulic fluid line adapted for communication between the first pump discharge port and the first steering cylinder first port, a second hydraulic fluid line adapted for communication between the second pump discharge port and the last steering cylinder second port, and means adapted for communication with each of the tie lines and operably connected to said first and second fluid lines, and operable, during the presence of fluid under pressure supplied by the pump in one of the first and second fluid lines, and in response to the absence of fluid under pressure in any one of the tie lines, for preventing propulsion unit steering movement.

9. A hydraulic control unit for a marine installation comprising a helm station comprising a pump including first and second pump discharge ports, and means for selectively and alternatively delivering fluid under pressure from the pump to the first and second pump discharge ports, a plurality of steerable propulsion units, a corresponding plurality of hydraulic steering cylinders respectively connected to each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, additional tie lines connecting successive steering cylinder second ports and the following steering cylinder first ports, said hydraulic control unit including a first hydraulic fluid line adapted for communication between the first pump discharge port and the first steering cylinder first port, said first fluid line including a plurality of normally closed first check valves dividing said first line into an upstream portion adapted for communication with the first pump discharge port, and a downstream portion adapted for communication with the first steering cylinder first port, said first check valves opening in response to the presence of fluid under pressure in said upstream portion of said first line, a second hydraulic fluid line adapted for communication between the second pump discharge port and the last steering cylinder second port, said second fluid line including a plurality of normally closed second check valves dividing said second line into an upstream portion adapted for communication with the second pump discharge port, and a downstream portion adapted for communication with the last steering cylinder second port, said second check valves opening in response to the presence of fluid under pressure in said upstream portion of said second line, and means adapted for communication with each of the tie lines and operably connected to said first and second fluid lines, and operable, during the presence of fluid under pressure supplied by the pump in one of the first and second fluid lines, and in response to the absence of fluid under pressure in any one of the tie lines, for preventing propulsion unit steering movement, said means for preventing steering movement of one of the propulsion units being operative in the absence of fluid under pressure in one of said first and second lines and in response to the presence of fluid under pressure in all of the tie lines, for opening said check valves in said one of said first and second lines.

10. A hydraulic control unit in accordance with claim 9 wherein said means operative for opening said check valves in said one of said first and second lines comprises a plurality of first and second cylinders-piston assemblies respectively associated with each of said plurality of first and second check valves, each of said cylinder-piston assemblies in said first and second cylinder-piston assemblies including a cylinder adapted at one end for communication with one of each of the tie lines and a piston movable in said cylinder and displaceable, in response to fluid under pressure in the one tie line, so as to effect opening of the associated one of said check valves.

11. A hydraulic control unit in accordance with claim 9 and further including means adapted for communication with one of the tie lines and operatively connected to each of the first and second fluid lines, and operable, when the steerable propulsion units are in nonangularly aligned steering positions, for locating the steerable propulsion units in angularly aligned positions.

12. A hydraulic control unit in accordance with claim 11 wherein said means for locating the steerable propulsion units in angularly aligned positions comprises a first plurality of pressure relief valves communicating with one of said first and second lines and respectively adapted for communication with each of the tie lines for permitting fluid flow from said one of said first and second lines to each of the tie lines when the pressure in said one of said first and second lines is above a predetermined value, and a second plurality of pressure relief values respectively adapted for communication with each of the tie lines and with said upstream portion of the other of said first and second lines and permitting fluid flow from each of the tie lines to said upstream portion of said other of said first and second lines when the pressure in each of the tie lines is above a predetermined value.

13. A hydraulic control unit in accordance with claim 8 and further including means adapted for communication with one of the tie lines and operatively connected to each of the first and second fluid lines, and operable, when the steerable propulsion units are in nonangularly aligned steering positions, for locating the steerable propulsion units in angularly aligned positions.

14. A hydraulic control unit in accordance with claim 13 wherein said means for locating the steerable propulsion units in angularly aligned positions comprises a first plurality of pressure relief valves communicating with one of said first and second lines and respectively adapted for communication with each of the tie lines for permitting fluid flow from said one of said first and second lines to each of the tie lines when the pressure in said one of said first and second lines is above a predetermined value, and a second plurality of pressure relief valves respectively adapted for communication with the each of the tie lines and with said upstream portion of the other of said first and second lines and permitting fluid flow from each of the tie lines to said upstream portion of said other of said first and second lines when the pressure in each of the tie lines is above a predetermined value.

15. A marine installation comprising a helm station comprising a pump including first and second pump discharge ports, and means for selectively and alternatively delivering fluid under pressure from said pump to said first and second pump discharge ports, a plurality of steerable propulsion units, a corresponding plurality of hydraulic steering cylinders respectively connected to each of said steerable propulsion units and including respective first ports which, when subject to fluid under pressure, tend to steer said propulsion units in one direction and including respective second ports which, when subject to fluid under pressure, tend to steer said propulsion units in the opposite direction, a first tie line connecting a first steering cylinder second port and a second steering cylinder first port, additional tie lines connecting successive steering cylinder second ports and the following steering cylinder first ports, and a hydraulic control unit including a first hydraulic fluid line communicating between said first pump discharge port and said first steering cylinder first port, a second hydraulic fluid line communicating between said second pump discharge port and the last steering cylinder second port, and means communicating with each of said tie lines and operably connected to said first and second fluid lines, and operable, during the presence of fluid under pressure supplied by said pump in one of the first and second fluid lines, and in response to the absence of fluid under pressure in any one of said tie lines, for preventing propulsion unit steering movement.

16. A marine installation comprising a helm station comprising a pump including first and second pump discharge ports, and means for selectively and alternatively delivering fluid under pressure from said pump to said first and second pump discharge ports, a plurality of steerable propulsion units, a corresponding plurality of hydraulic steering cylinders respectively connected to each of said steerable propulsion units and including respective first ports which, when subject to fluid under pressure, tend to steer said propulsion units in one direction and including respective second ports which, when subject to fluid under pressure, tend to steer said propulsion units in the opposite direction, a first tie line connecting a first steering cylinder second port and a second steering cylinder first port, additional tie lines connecting successive steering cylinder second ports and the following steering cylinder first ports, and a hydraulic control unit including a first hydraulic fluid line communicating between said first pump discharge port and said first steering cylinder first port, said first fluid line including a plurality of normally closed first check valves dividing said first line into an upstream portion communicating with said first pump discharge port, and a downstream portion communicating with said first steering cylinder first port, said first check valves opening in response to the presence of fluid under pressure in said upstream portion of said first line, a second hydraulic fluid line communicating between said second pump discharge port and the last steering cylinder second port, said second fluid line including a plurality of normally closed second check valves dividing said second line into an upstream portion communicating with said second pump discharge port, and a downstream portion communicating with said last steering cylinder second port, said second check valve opening in response to the presence of fluid under pressure in said upstream portion of said second line, and means communicating with each of said tie lines and operably connected to said first and second fluid lines, and operable, during the presence of fluid under pressure supplied by said pump in one of the first and second fluid lines, and in response to the absence of fluid under pressure in any one of said tie lines, for preventing propulsion unit steering movement, said means for preventing propulsion unit steering movement being operative, in the absence of fluid under pressure in one of said first and second lines and in response to the presence of fluid under pressure in all of said tie lines, for opening said check valves in said one of said first and second lines.

17. A marine installation in accordance with claim 16 wherein said means operative for opening said check valves in said one of said first and second lines comprises a plurality of cylinder-piston assemblies respectively associated with each of said plurality of first and second check valves, each of said cylinder-piston assemblies including a cylinder communicating at one end with one of said tie lines and a piston movable in said cylinder and displaceable, in response to fluid under pressure in the associated tie line, so as to effect opening of the associated one of said check valves.

18. A marine installation in accordance with claim 16 and further including means communicating with one of said tie lines and operably connected to each of said first and second fluid lines, and operable, when said steerable propulsion units are located in nonangularly aligned steering positions, for locating said steerable propulsion units in angularly aligned positions.

19. A marine installation in accordance with claim 18 wherein said means for locating said steerable propulsion units in angularly aligned positions comprises a first plurality of pressure relief valves communicating with one of said first and second lines and respectively with each of said tie lines for permitting fluid flow from said one of said first and second lines to each of said tie lines when the pressure in said one of said first and second lines is above a predetermined value, and a second plurality of pressure relief valves communicating respectively with each of said tie lines and with said upstream portion of the other of said first and second lines and permitting fluid flow from each of said tie lines to said upstream portion of said other of said first and second lines when the pressure in each of said tie lines is above a predetermined value.

20. A marine installation in accordance with claim 15 and further including means communicating with one of said tie lines and operably connected to each of said first and second fluid lines and operable, when said steerable propulsion units are located in nonangularly aligned steering positions, for locating said steerable propulsion units in angularly aligned positions.

21. A marine installation in accordance with claim 20 wherein said means for locating said steerable propulsion units in angularly aligned positions comprises a first plurality of pressure relief valves communicating with one of said first and second lines and respectively with each of said tie lines for permitting fluid flow from said one of said first and second lines to each of said tie lines when the pressure in said one of said first and second lines is above a predetermined value, and a second plurality of pressure relief valves communicating respectively with each of said tie lines and with said upstream portion of the other of said first and second lines and permitting fluid flow from each of said tie lines to said upstream portion of said other of said first and second lines when the pressure in each of said tie lines is above a predetermined value.

* * * * *